US005322984A

United States Patent [19]

Habeger, Jr. et al.

[11] Patent Number: 5,322,984

[45] Date of Patent: Jun. 21, 1994

[54] ANTENNA FOR MICROWAVE ENHANCED COOKING

[75] Inventors: Charles C. Habeger, Jr., Appleton; Ellen E. Pelky, Little Chute, both of Wis.; Terrence P. Lafferty, Cincinnati, Ohio

[73] Assignee: James River Corporation of Virginia, Richmond, Va.

[21] Appl. No.: 22,949

[22] Filed: Feb. 26, 1993

Related U.S. Application Data

[63] Continuation-in-part of Ser. No. 863,086, Apr. 3, 1992, abandoned.

[51] Int. Cl.[5] ..... H05B 6/80

[52] U.S. Cl. ..... 219/728; 426/234; 426/243; 99/DIG. 14; 219/748

[58] Field of Search ..... 219/10.55 F, 10.55 E, 219/10.55 A, 10.55 R; 99/DIG. 14, 451; 426/243, 234, 107; 343/866, 867

[56] References Cited

U.S. PATENT DOCUMENTS

| | | | |
|---|---|---|---|
| 3,271,552 | 9/1966 | Krajewski | 219/10.55 E |
| 3,591,751 | 7/1971 | Goltsos | 219/10.55 E |
| 3,946,187 | 3/1976 | MacMaster et al. | 219/10.55 E |
| 4,320,274 | 3/1982 | Dehn | 219/10.55 E |
| 4,460,814 | 7/1984 | Diesch et al. | 219/10.55 F |
| 4,816,634 | 3/1989 | Lentz et al. | 219/10.55 F |
| 4,866,234 | 9/1989 | Keefer | 219/10.55 F |
| 4,883,936 | 11/1989 | Maynard et al. | 219/10.55 E |
| 4,888,459 | 12/1989 | Keefer | 219/10.55 E |
| 4,934,829 | 6/1990 | Wendt | 219/10.55 E |
| 4,992,636 | 2/1991 | Namiki et al. | 219/10.55 E |

*Primary Examiner*—Philip H. Leung

*Attorney, Agent, or Firm*—Sixbey, Friedman, Leedom & Ferguson

[57] ABSTRACT

A microwave responsive heating device useful in microwave packaging for capturing microwave energy in a microwave oven and transmitting the energy to a surface of a food item in a concentrated form to grill, crisp, or brown the surface thereof. The heating device includes an antenna for collecting the microwave energy and a transmission device for transferring the collected energy from the antenna to a surface of a food item. Preferably, the heating device forms an integral portion of the interior of a food package to allow a food item to be stored and cooked therein. The antenna and the transmission device are made from electrically conductive materials and are shaped to, not only, capture and transmit microwave energy efficiently, but also to enhance the intensity of the microwave energy in a concentrated form.

47 Claims, 10 Drawing Sheets

ANTENNA FOR MICROWAVE ENHANCED COOKING

This is a continuation-in-part of Ser. No. 863,086 filed on Apr. 3, 1992, now abandoned.

BACKGROUND OF THE INVENTION

1. Technical Field of the Invention

This invention generally relates to the production of microwave oven cooking elements useful both for food packaging, as well as in reusable utensils and specifically, to the production of microwave cooking elements which are capable of capturing and transferring microwave energy to the surface of a food item to be cooked in a microwave oven.

2. Description of the Background Art

The popularity of microwave ovens for cooking all or part of a meal has led to the development of a large number of food packages capable of cooking a food item in a microwave oven directly in the food package in which it is stored. The convenience of cooking food in its own package or a component thereof appeals to a large number of consumers. Further, many fast food restaurants are looking to fast, yet effective, ways of cooking and warming food which is less expensive than currently used methods. However, one dissatisfaction of microwave cooking for some foods is the inability to brown the food. It is often difficult to obtain grilling, browning and crisping of certain types of food in a microwave oven.

Microwave interactive films have been produced which are capable of generating heat at the food surface to crispen some food products. U.S. Pat. No. 4,883,936, issued to Maynard et al. and assigned to James River Corporation of Virginia, assignee of the present application, discloses the production of a microwave interactive heating element for food packaging which is selectively deactivated to provide an area or areas of microwave interactive material and an area or areas of deactivated material in a pattern on the surface of the heating element, so that only the area or areas having the interactive material untreated are fully capable of generating heat. Specifically, the patterned, deactivated heating element disclosed by Maynard et al. can be used to selectively brown the surface of a food item. Unfortunately, some food items, particularly very thick or solid foods, such as chicken fillets, absorb such a large portion of microwave radiation that the crisping element does not intercept sufficient energy for the desired browning and crisping at the surface of such a food item.

Other devices have also been developed to brown the surface of a food item in a microwave oven. U.S. Pat. No. 3,591,751, issued to Goltsos, discloses a browning apparatus for use in a microwave oven. Specifically, the apparatus includes microwave coupling devices located in contact or in close proximity to a food item for the purpose of browning. The coupling devices may be a plurality of metal rods supported on a dielectric board. The length of the rods themselves are integer multiples of a half wavelength with respect to the frequency of the microwave source to cause a resonant increase in the microwave currents on the surface of the rods. A separate apparatus may be used on both the top and the bottom of the food item to attempt to brown both sides thereof. However, using conventional single source microwave ovens in which the microwave source is located near the top of the oven cavity, more browning is observed on the top surface of the food than on the bottom surface of the food due to "shadowing" by the rods of the device on the top. A similar result in reverse holds true for microwave ovens in which the microwave source is located only near the bottom. Goltsos suggests providing two microwave source feeds located near the top and the bottom of the oven or a coupler to provide dual feeds. However, because conventional microwaves used by most consumers today only include a single microwave source near the top of the oven, this "shadowing" effect would occur while using the apparatus disclosed by Goltsos and therefore, would not be suitable for mass produced consumer use. Moreover, the apparatus of Goltsos is a large separate appliance type device and is, therefore, not contemplated to be used for food packaging.

U.S. Pat. No. 3,946,187, issued to MacMaster et al., discloses another example of a microwave browning or searing utensil for use in a microwave oven. The device is provided with a plurality of conductive metal members each of which are folded in such a manner to provide a continuous apex and two substantially equidistant legs. The legs are substantially one-quarter of a wavelength in height. Microwaves irradiated within the oven are converted by the array of conductive members to provide an intense fringing electric field in close proximity to a food item being heated thereon. The utensil may rest upon the floor of the oven cavity and may also be supported on top of a food load, as in Goltos et al. Again, however, while use of upper and lower utensils are suggested, there is no means for directing the microwave energy to both utensils disclosed in this patent, so the effects of "shadowing," discussed above, may still present a problem. Moreover, the device disclosed by MacMaster et al. is a separate utensil which is not designed to be disposable, as in popular microwave food packaging.

Devices have also been developed for providing uniform heating by microwave energy at desired points within an area of the microwave oven cavity. U.S. Pat. No. 3,271,552, issued to Krajewski, discloses a microwave heating apparatus which includes small antennas or supplemental radiating elements, which are preferably screwed into threaded holes provided in a portion of a wall of the microwave oven, to apply concentrated microwave energy to a food item. Krajewski also discloses the use of conductive strips which may be secured to and form a part of a food package. Specifically, the strips may be present as aluminum foil strips or rods. These elements do not, however, contact a food item nor provide browning or crisping thereof. Rather, the elements merely concentrate existing microwave energy which is present in the oven cavity.

Namiki et al. disclose in U.S. Pat. No. 4,992,636 a sealed container for microwave oven cooking wherein a lid is partially melted by microwave energy to form an opening therein. Specifically, the lid includes an antenna made of an electrically conductive material which concentrates microwave energy at a position near the front of the antenna and converts this energy to heat in order to melt a portion of the lid. However, the antenna does not provide a browning or crisping effect on food held within the container.

Some antennas have been developed which are useful for efficiently distributing heat within the interior of a food product, such as a turkey. U.S. Pat. No. 4,460,814, issued to Diesch et al., discloses an oven antenna probe for distributing energy in a microwave oven. Specifically, the antenna probe is designed to be inserted into a food item to distribute microwave energy within the food to provide adequate cooking inside and out. The antenna includes a source end antenna element which delivers power to a load end configured as a probe for insertion into the food. Several of the antenna-like structures may also be positioned throughout the oven cavity for reradiating energy towards a food product. The antennas do not, however, provide a sufficient amount of energy concentration to brown the surface of a food item, but rather redistribute the energy within the oven cavity to effectively cook a food item so that a similar amount of heating occurs at the center of a food item as at the outer portion of the food.

In addition, Keefer discloses in two U.S. Pat. Nos. 4,866,234 and 4,888,459, a microwave container which redistributes heat in a microwave oven to avoid "cold spots" which are commonly found within a microwave oven cavity. Specifically, the container may include a two-dimensional antenna or a slot antenna for receiving microwave energy in the oven cavity and to create a microwave field pattern or to act as a window for microwave energy, respectively. Again, these "antennas" do not provide a sufficient amount of concentrated or enhanced microwave energy near a food item to brown or grill the surface thereof.

Furthermore, U.S. Pat. No. 4,816,634 discloses a method and apparatus for measuring strong microwave electric field strengths. Moreover, this patent, as well as U.S. Pat. No. 4,934,829 disclose the use of cylindrical wave guides for cooking multi-component, layered food items. These disclosures are primarily directed to test probes or strips and do not provide a means of capturing and transferring energy in a microwave oven.

Consequently, a microwave oven heating device is needed which effectively captures microwave energy present in an oven cavity and transmits it to the surface of a food item which is conventionally browned or grilled. Further, a device is needed for heating or grilling food items in conventional, one source microwave ovens which can be included in disposable microwave food packaging or in reusable utensils.

SUMMARY OF THE INVENTION

Therefore, a primary object of the present invention is to overcome the deficiencies of the prior art, as described above, and specifically, to provide a microwave responsive heating device to receive and transfer enhanced energy to the surface of a food item to effectively heat the surface thereof.

Another object of the present invention is to provide a microwave responsive heating device for microwave food packaging which effectively operates in a conventional, one source microwave oven.

Yet another object of the present invention is to provide a microwave responsive heating device suitable either for use in a reusable utensil or for insertion into a carton for storing and cooking a food item in a microwave oven to provide a commercially appealing disposable food container wherein the device captures microwave energy in the microwave oven and transmits the energy in a concentrated form to crisp or grill a surface of a food item held within the carton.

Still another object of the present invention is to provide a microwave responsive heating device which includes an antenna member to capture microwave energy and a transmission portion to transmit the energy to the surface of a food item in a concentrated or enhanced form.

Yet another object of the present invention is to provide a microwave responsive heating device which includes an antenna member shaped to efficiently capture microwave energy in one area of a microwave oven and a transmission portion shaped to efficiently transmit that energy to the surface of a food item in another area of the oven wherein the energy supplied to the food item from the transmission portion is sufficiently enhanced to crisp or grill the surface of the food item.

Still another object of the present invention is to provide a microwave responsive heating device which includes an antenna member shaped to efficiently capture microwave energy in one area of a microwave oven away from the food, a transmission portion to transmit the energy and a resistive element to supply heat energy to the surface of a food item in another area of the oven wherein the heat energy supplied to the food item is sufficiently enhanced to crisp or grill the surface of the food item.

Another object of the present invention is to provide a microwave responsive heating device which includes an antenna member shaped to efficiently capture microwave energy in one area of a microwave oven away from the food, a transmission portion to transmit the energy and a microwave interactive means adjacent the transmission portion to supply enhanced heat energy to a food item in heat transfer relationship with the microwave interactive means.

The foregoing objects are achieved by providing a microwave responsive heating device for capturing microwave energy in a microwave oven and for transmitting the energy to a surface of a food item in a concentrated form to grill, crisp, or brown the surface thereof. The heating device includes an antenna for collecting the microwave energy and a transmission portion for transferring the collected energy from the antenna to a surface heating zone, separate from the antenna, to heat the surface of the food item. Preferably, the heating device is designed to be integral with the interior portions of a food package to allow a food item to be stored and cooked within the food package. The antenna and the transmission portion are made from electrically conductive materials and are shaped to not only capture and transmit microwave energy, but also to enhance the intensity of the microwave energy. The present invention provides a commercially feasible device useful in food packaging for heating and/or browning food items that are conventionally grilled and have, until now, been inappropriate for microwave cooking.

In preferred embodiments, the antenna comprises a folded-dipole located away from the food, while in more preferred embodiments, the transmission and heating portions are closely impedance matched to the folded-dipole. In the most preferred embodiments, the heating device will comprise at least one endless loop, ideally having two or more folded-dipoles arranged in a compact array spaced away from but surrounding the foodstuff, the array being connected to transmission means leading to heating means adjacent the surface to be grilled, crisped, or browned. This configuration has been found to be surprisingly effective in capturing energy and transmitting it to the heating portion while alleviating potential for arcing. In addition, it can be combined with a microwave interactive material to boost the heat generating ability of the microwave interactive material.

The various features, objects and advantages of the present invention will become apparent from the following Brief Description of the Drawings and Detailed Description of the Invention.

DETAILED DESCRIPTION OF THE INVENTION

The convenience and speed of microwave cooking has led to ever increasing interest in devices which cook a food item in such a way that it appears and tastes as if it were cooked in a conventional manner. The problem with conventional microwave ovens is that a large number of food items, when heated or cooked therein, do not achieve even a minimally acceptable appearance or taste. Among such food items are conventionally fried or grilled foods, such as fish, chicken, or hamburgers. Devices have been developed to attempt to improve the taste and appearance of such microwave cooked foods, however, these devices, are not particularly effective in conventional one-source microwave ovens. Moreover, the development of food packaging designs which allow the storage and microwave cooking of a food item in the package itself have become very attractive to consumers in recent years. The devices designed thus far for browning or grilling food items are generally separate, bulky devices which are not readily adaptable to food packaging. The present invention provides a device which is effective in grilling and crisping high bulk food items and which is readily adaptable to disposable food packaging.

Figure 1:
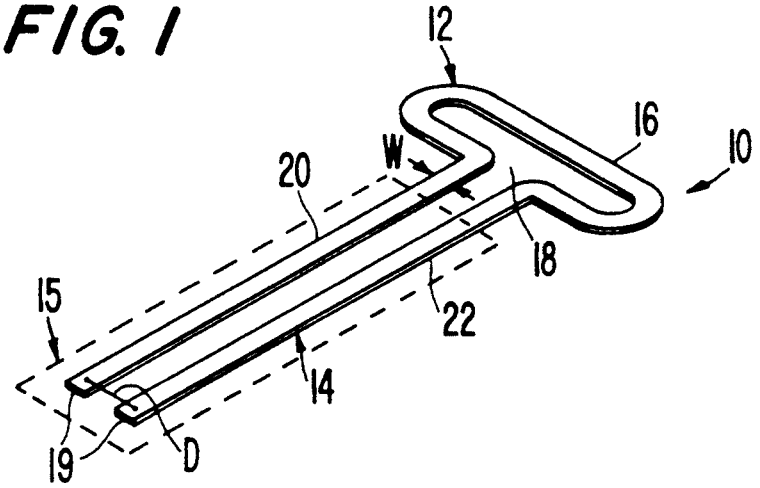
FIG. 1 illustrates a microwave heating device including a single folded-dipole antenna of aluminum foil laminated to paperboard.

For a clearer understanding of the present invention, attention is initially directed to FIG. 1. Figure 1 illustrates one embodiment of heating device 10 of the present invention made from metal foil laminated to paperboard. Heating device 10 is preferably designed to be included in a food package. Device 10 includes a folded-dipole antenna 12 and transmission portion 14 which includes a surface heating zone 15 located spaced away from antenna 12. A food item may be placed directly on transmission portion 14 or at least in close proximity thereto. The size and shape of surface heating zone 15 is, therefore, dependent upon the size and shape of the food item. As a result, the dashed lines used to represent surface heating zone 15 in the Figures is merely provided as an approximation of many possible surface heating zone dimensions which are separate from the microwave capturing antenna.

Specifically, antenna 12 is shaped to capture microwave energy in regions away from the foodstuff and transmission portion 14 enhances the effectiveness of this energy by efficiently transferring it to a food item in surface heating zone 15. Antenna 12 and transmission portion 14 are made from a conductive material, such as metal foil, as shown in FIG. 1, conductive ink or metal wire. These materials provided are merely examples of appropriate materials to be used for these components and should not be considered exhaustive of the possible materials suitable for the present invention. Moreover, as will be discussed in greater detail below, antenna 12 and transmission portion 14 are also carefully impedance matched to allow the coupling of large amounts of radiation to the surface of the food item.

Preferably, antenna 12 is a folded dipole. Specifically, as shown in FIGS. 1, 2 and 4–6, antenna 12 includes a tight, elongated loop 16 of conductive material having a narrow gap 18 in the middle of one side. For optimal performance, the length of the antenna is preferably approximately 0.48 of a wavelength or 5.875 cm. Transmission portion 14 is a parallel run of two transmission members 20 and 22 which are generally made from the same material as antenna 12.

Specifically, addressing antenna 12, a dipole is a pair of equal length, collinear conductors separated by a short gap. The antenna terminals are on the opposite sides of the gap. If the total length of the dipole, represented as L, is maintained small compared to the electromagnetic wavelength produced within the microwave oven wherein the wavelength, $\lambda$, is approximately 12.24 cm, and a randomly-polarized, isotropic pattern of radiation is incoming, the dipole intercepts an amount of power equal to that power incident on a surface area of $\lambda^2/4$. Therefore, the amount of power should be independent of the length of the antenna. The directivity of the dipole increases with length, and therefore, in order to avoid large sensitivity of the power absorption to oven placement, it is desirable to keep the dipole relatively short.

The important property of the dipole that does change rapidly with L is its impedance. For lengths significantly less than $\lambda/2$, the impedance has a large capacitive component and for lengths between $\lambda/2$ and $\lambda$, the inductive part can be large. At about $0.48\lambda$ the reactive component is zero, and the antenna impedance is real (about 73 Ohms). To avoid reflection at the terminals of the antenna and the concomitant re-radiation of the energy by the antenna, the antenna impedance should match the impedance of the transmission portion. This means that the impedance of the antenna should be near the complex conjugate of the transmission portion impedance. Simple transmission lines have real impedances (no inductive or capacitive components). Therefore, to avoid complex reactive matching networks, a straightforward approach is to use a $0.48\lambda$ (5.875 cm) dipole and 73 Ohm transmission line or portion.

Figure 2:
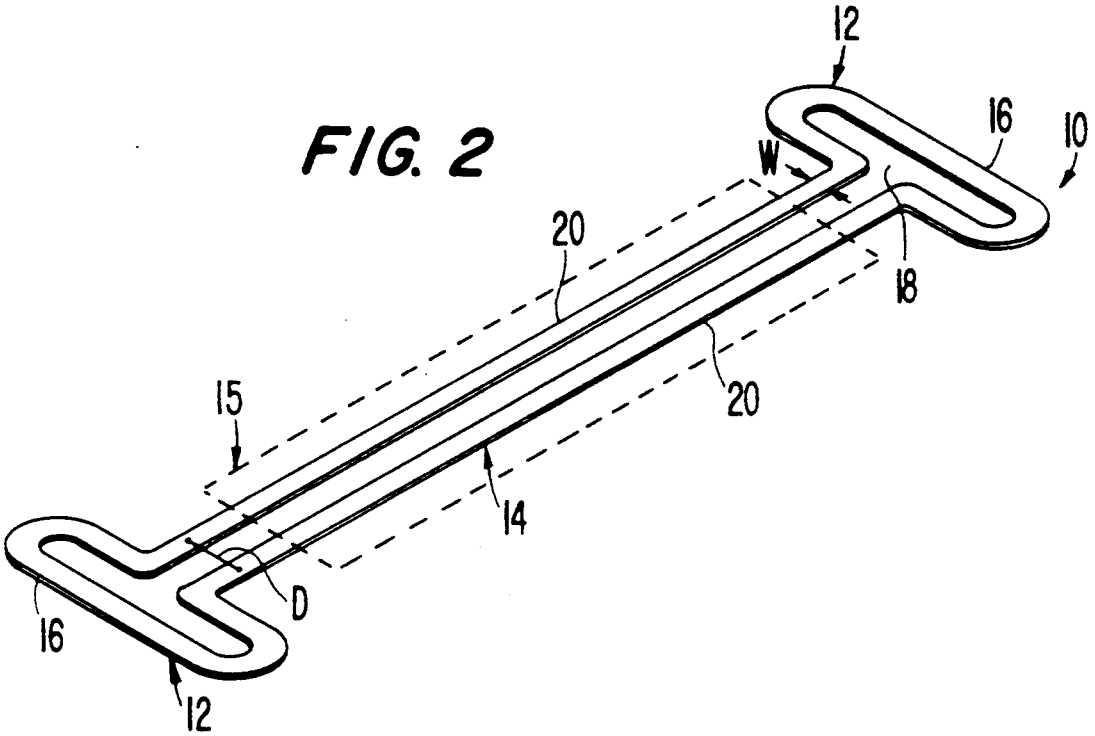
FIG. 2 illustrates a microwave heating device including a double folded-dipole antenna constituting an endless loop.

FIG. 2 illustrates a second embodiment of heating device 10 wherein antennas 12 are provided at each end of transmission portion 14. This provides increased microwave intensity in transmission portion 14 and ultimately to the surface of the food item. Such a design produces long heating or grill marks on a food item held in close proximity thereto. Specifically, each of the antennas capture microwave energy so that it may be transferred down transmission portion 14 to surface heating zone 15. Further, the endless loop configuration in FIG. 2 alleviates the potential for arcing present at ends 19 in the configuration shown in FIG. 1.

Figure 3:
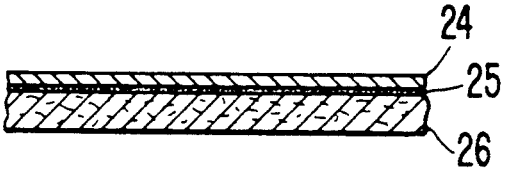
FIG. 3 illustrates a cross-section of one embodiment of the present invention including a rigid support layer and a layer of aluminum foil adhered thereto.

FIG. 3 shows a cross-sectional view of one method of forming heating device 10 of FIGS. 1 and 2. Specifically, layer 24 represents aluminum foil which is initially laminated to a rigid substrate 26. Layer 24 is fixed by a laminating adhesive 25 to substrate 26. Although a laminating adhesive is disclosed in FIG. 3, any conventional means of attaching layer 24 to substrate 26 would be acceptable. Substrate 26 should be at least semi-rigid to maintain the integrity of heating device 10. Preferably, substrate 26 comprises paper or paperboard, such as a paperboard food carton or container. Heating device 10 is then formed by die cutting layer 24 and substrate 26 into the desired shape, such as those illustrated in FIGS. 1 and 2. A heating device designed in such a manner provides a cost effective microwave heater which can be mass produced and disposable with a food package after use.

Figure 4:
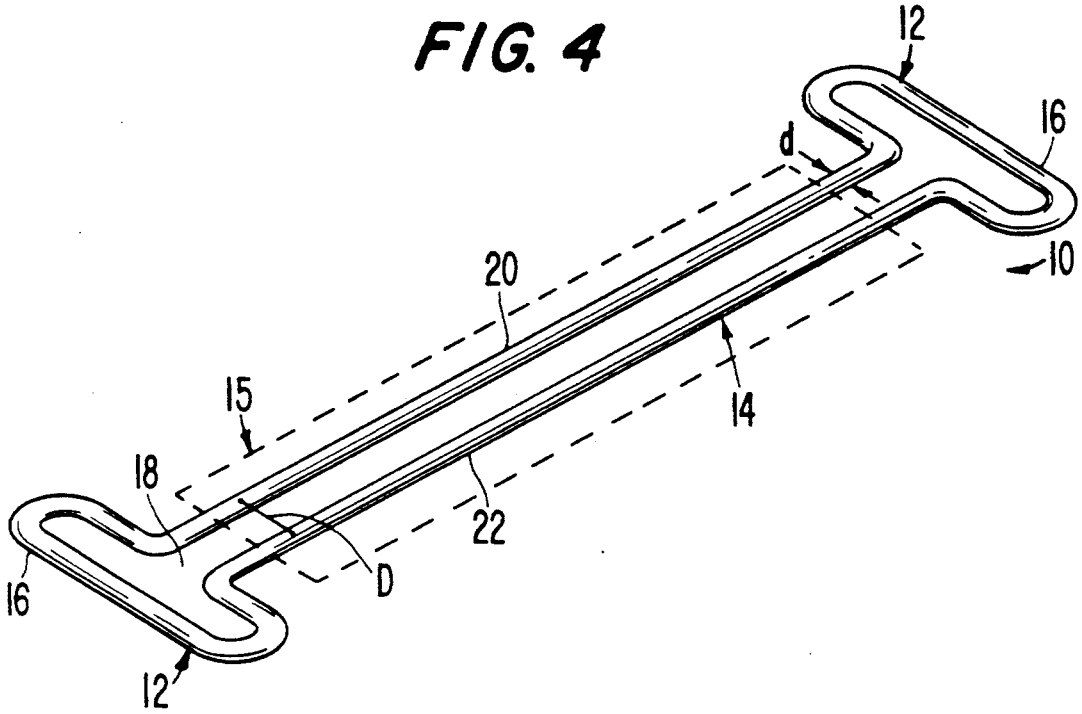
FIG. 4 illustrates a second embodiment of the present invention wherein the microwave heating device comprises metal wire.

FIG. 4 illustrates yet another embodiment of the present invention wherein heating device 10 is made from a conductive metal wire. Preferably, heating device 10 would be at least insertable into a food package and in this embodiment could be removed from the package and placed with the antenna away from and the heating portion against the foodstuff to provide a surface heating zone for a food item originally contained in the microwave food carton or package.

Figure 4A:
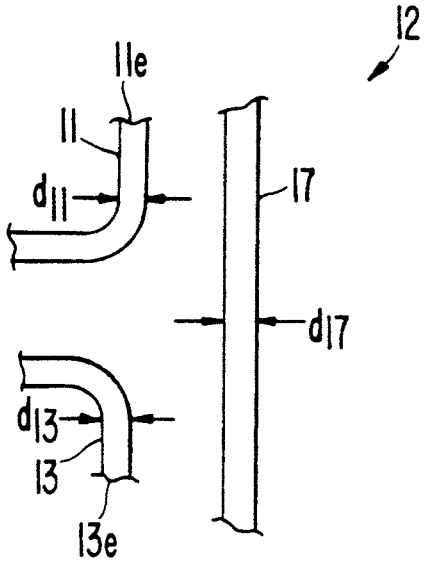
FIG. 4A illustrates a portion of the folded-dipole antenna of the present invention.

The importance of the "folded-dipole" antenna in the embodiments illustrated in FIGS. 1, 2 and 4 becomes readily apparent with reference to the discussion below, and due to the fact that the impedance of parallel transmission members, as used in the present invention, commonly have impedances significantly greater than 73 Ohms. The transmission portion 14 is preferably integral with the surface of a food carton or package and includes parallel transmission members 20 and 22. For initial analysis purposes, antenna 12 will be assumed to be made from conductive cylindrical wire material, as depicted in FIG. 4. The impedance of the $0.48\lambda$ dipole wire antenna can be multiplied by "folding". The configuration of the folded-dipole is best understood with reference to FIG. 4A in which the folded-dipole has collinear legs 11 and 13 electrically connected at their respective ends 11*e* and 13*e* to folded section 17, which is parallel to legs 11 and 13. By adjusting the radius of the legs 11 and 13 and the radius of folded section 17, the impedance of the antenna can be estimated by multiplying 73 Ohms by a factor determined from charts, such as the step-up transmission chart for a folded dipole, as provided in FIGS. 4–19 from the *Antenna Engineering Handbook*, 2nd Edition, by Richard C. Johnson and Henry Jasik, McGraw Hill, 1961. So, by properly adjusting the dimensions of the legs and folded section of the folded-dipole, its impedance can be conveniently selected to any value between 73 ohms and about ten times 73 Ohms. For example, the multiplication factor is 4 when two wires have the same radius, while it becomes greater than 4 when the folded section is fatter. In preferred embodiments, the impedance of the antenna is closely matched to the impedance of the transmission portion. Parallel, round wire transmission lines or members have an impedance of:

$$Z_{pl}=120\cosh^{-1}(D/d)\text{ Ohms} \quad (1)$$

where D is the center separation of the transmission members and d is the diameter of the round wire in the transmission portion. For effective coupling of energy onto the transmission members 20 and 22, the impedance of the transmission portion should be equal to the impedance of antenna 12. Therefore, for folded-dipoles having legs 1 1 and 13, respectively, and folded sections 17 of equal diameters, the center separation D of the transmission members divided by the diameter d of the round wire in the transmission members, as illustrated in FIG. 4, is found from $4(73)=120\cosh^{-1}(D/d)$ or $D/d=5.7$.

For flat line or planar antenna calculations, the effective radius of a thin, flat conductor, as shown in FIGS. 1, 2, 5 and 6, is ¼ its width. Therefore, the y-axis of the chart should be changed to the center separation divided by four times the width of the dipole. The impedance of this planar transmission portion is:

$$Z_{pl}=(120\cosh^{-1}(2D/w)\text{ Ohms} \quad (2)$$

where D is the center separation of the transmission members and w is the width of each transmission member. For effective separation of transmission members 20 and 22, D/w must exceed 1. Therefore, the minimum impedance of this type of line is $120\cosh^{1}-(2)$ or about 160 Ohms. Because this value is greater than 73 Ohms, impedance matching to a properly configured folded-dipole antenna 12 is important for effective utilization of the present invention in a food packaging environment. So, in a particular design, the parameters of the 5.875 cm folded-dipole antenna must be chosen so that the impedance determined from the chart referred to above equals that of the transmission members 20 and 22 from Eqn. 2. Therefore, for the special case of uniform width, folded dipole antenna 12, as illustrated in FIGS. 1 and 2, the relationship of the center separation over the width is $4(73)=120\cosh^{-1}(2D/w)$ or $D/w=2.85$.

Antenna 12 and transmission portion 14 must be made of a highly conductive material. If these lines are too resistive, significant amounts of energy will be lost in the reception and transmission phases, and the system will not function properly. Aluminum foil is sufficiently conductive for purposes of the present invention. Nonetheless, it might be desirable to use conductive inks or conductive wire instead. In view thereof, the present invention should not be limited to the conductive materials specifically described herein, but should include any material that is sufficiently conductive to provide transmission of electromagnetic waves.

For the ohmic losses in antenna 12 and transmission members 20 and 22 to be very small compared to the delivered power, the total end-to-end resistance of members 20 and 22 should preferably be small compared to $Z_{pl}$. At microwave frequencies, the skin depth, $\delta$, of the electrical currents into good conductors is of the order of microns, and, since $\delta$ may be less than the thickness of the transmission member, t, all of the transmission member may not be available for charge transfer. Therefore, the resistance (RT) of the total transmission member should preferably be taken as the greater of $LT/\sigma 2w\delta$ and $LT/\sigma wt$, where $\sigma$ is the transmission member bulk conductivity, LT is the total transmission member length, and w is the width of the transmission member. Now, $\delta$ is related to $\sigma$ and the frequency as $\delta=[1/\pi f\mu\sigma]^{\frac{1}{2}}$. At 2.45 GHz this becomes $\delta$ in meters equals $0.01/\sigma^{\frac{1}{2}}$, when $\sigma$ is in reciprocal meter Ohms. So, the conditions for an acceptable conductive material in the mks system are that $$\sigma>[50\ LT/wZ_{pl}]^2, \tag{3}$$

and $$\sigma>LT/wtZ_{pl} \tag{4}$$

For example, take a conductive ink in the mid range of available silver-based polymer films ($\sigma=5\times10^5$1/mOhm) and allow a 5% loss of energy in transmission. If $t=2\delta$, effective use of the conductive ink is possible, and Eqn. (3) and (4) are equivalent. So if t is 28 $\mu$m, this ink is acceptable if $LT/wZ_{pl}$ is less than 0.7/Ohm.

The heating of a food item by device 10 is actually accomplished by increased electromagnetic fields near transmission members 20 and 22 due to power transmission. An analysis of the electromagnetic fields surrounding at least one of the transmission members of heating device 10 of FIG. 4 may be helpful to an understanding of the present invention. Assuming transmission members 20, with a radius, r, embedded in a dielectric material of permittivity, $\epsilon$, and a center separation, D, the z-axis of a cylindrical coordinate system can be aligned with transmission member 20 to consider the losses therefrom out to a distance of $r=D/2$, ignoring the fields generated by transmission member 22. The fundamental, traveling wave field distributions associated with open transmission lines are transverse electromagnetic (TEM) waves. Therefore, a TEM solution that satisfies the boundary conditions imposed by a round wire in an infinite dielectric is important.

Using the conventional form for sinusoidal times dependence ($e^{i\omega t}$), the z-direction dependence of a forward-traveling, TEM wave is $e^{-ikz}$, where $k^2$ is $\mu\epsilon$ (the permeability times the permittivity of the surrounding dielectric). The Cartesian components of the transverse E-field of a TEM wave must satisfy Laplace's equation. This means that $\nabla^2E_x=\nabla^2E_y=0$, where the differential operator is only in the transverse plane. A traveling wave solution to the transverse Laplace's equation having cylindrical symmetry and meeting the boundary condition that $E_\theta=0$ at $r=a$, is $$E_r=E_oe^{i\omega t-ikz}/r \tag{5}$$

and $$E_\theta=0 \tag{6}$$

For a TEM wave, the H-field is also in the transverse plane, but it is normal to the Enfield. Its magnitude is 1/Z of the E-field magnitude, where Z represents the characteristic impedance of the dielectric, $(\mu/\epsilon)^{\frac{1}{2}}$. Therefore, $$H_r=0 \tag{7}$$

and $$H_\theta=E_oe^{i\omega t-ikz}/Zr \tag{8}$$

The current, I, in transmission member 20 can be related to the fields by Stokes's equation for the H-field. That is, a line integral of the H-field around a circle enclosing transmission member 20 equals the current, or $$I=2\pi rE_oe^{i\omega t-ikz}/Zr=2\pi E_oe^{i\omega t-ikz}/Z \tag{9}$$

In view thereof, the dielectric power dissipation per unit volume, $D_v$, is equal to the real part of $E_oJ^*$, where $J^*$ is the current density. The only current in the dielectric is the displacement current, so $J=i\omega D=i\omega\epsilon E$. As a result, the per unit volume power dissipation then becomes $$D_v=\omega\epsilon''|E_o|^2e^{-2k''z}/r^2, \tag{10}$$

where $k''$ and $\epsilon''$ come from the imaginary parts of the wave number and the permittivity, i.e., $k=k'-ik''$ and $\delta=\epsilon'-i\epsilon''$. The inverse of $K''$ is called the penetration depth of the dielectric, namely, it is the distance a plane wave propagates into the dielectric before its amplitude drops by a factor of 1/e. The important things to note from Eqn. (9) are: (a) the power dissipation intensity increases as $1/r^2$ as you approach transmission number 20; (b) loss is proportional to the imaginary part of the dielectric constant; and (c) the wave is attenuated in the z-direction at the same exponential rate as plane wave radiation in the dielectric. In the real microwave oven, where transmission member 20 is placed on the food (not imbedded in it), the penetration depth should be approximately twice as great. So, if transmission member 20 carrying current passes over a food item, the surface intensified cooking will persist about twice as far as free space radiation normally penetrates into the food. The 2.45 GHz penetration depth of most foods is about 2 cm. Therefore, it is expected that energy received from antenna 12 and traveling down transmission portion 14 will intensify cooking for about two inches after the initial food-line intersection. As the food cooks and dries, the penetration depth will increase, and the heating will progress somewhat down transmission portion 14.

The power absorbed per unit length, $D_1$, is derived by integrating $2\pi r D_v$ over r from a to D/2. To get an estimate of the contribution of each transmission member, the single transmission member electromagnetic field is cut off at the midpoint of the two members. The result is $$D_1 = 2\pi\omega\epsilon''|E_o|^2 \ln(D/2a)e^{-2k''z} \quad (11)$$

So, the total power dissipated in the dielectric increases as the radius of the transmission member decreases, but slowly (only as a logarithm). It is important to recognize that changing the transmission member radius, while keeping wire current constant, does not alter the heat dissipation at any particular location in the dielectric, but only alters the domain in which a dielectric is submitted to intense electric fields.

There is also some heat dissipated directly in the transmission member. Assuming the radius of transmission member 20 is much greater than one skin depth, $\delta$, in radius, the effective resistance, R, of a round wire per unit length is approximately $1/(2\pi a\delta\sigma)$, where $\sigma$ is the bulk electrical conductivity of the wire. The power ($D_w$) generated in the wire per unit length is the real part of IRI*. Substituting I from Eqn. (9) writing the skin depth in terms of more basic parameters ($\delta = [2/\omega\mu\sigma]^{\frac{1}{2}}$), and using $Z = (\mu/\epsilon)^{\frac{1}{2}}$, provides the following expression for $D_w$:

$$D_w = \frac{2\pi\omega^{\frac{1}{2}}|\epsilon|\ |E_o|^2 e^{-2k''z}}{a(2\sigma\mu)^{\frac{1}{2}}} \quad (12)$$

This term also increases as the radius of the wire drops, but more rapidly than $D_1$. So, thinner transmission members have a larger portion of the total energy dissipated directly in the transmission member. Dividing Eqn. (11) by Eqn. (12) and manipulating, provides the ratio for the two types of heat loss as:

$$D_1/D_w = \frac{2a\sin\delta_1 \ln(D/2a)}{\delta} \quad (13)$$

Here $\sin\delta_1$, represents $\epsilon''/|\epsilon|$, the sine of the loss angle of the dielectric. For most foods, $\sin\delta_1$ is of the order of 0.1. So if the diameter of transmission member 20 and 22 is a few orders of magnitude greater than its skin depth, the majority of the loss will be in the surrounding dielectric. Under this condition, heat is directly produced in the dielectric. The transmission members 20 and 22 do not appreciably heat up and conduct thermal energy to the food. For metallic conductors having a skin depth, $\delta$, of a few micrometers, the dielectric losses will dominate for foods near transmission portion 14 having transmission members of any reasonable diameter, so that losses from currents in a 1 mil. (25.4 $\mu$m) thick aluminum foil should also be similarly in the dielectric regime.

The length of transmission members 20 and 22 is also important for a single antenna, as illustrated in FIG. 1. Electrically, the unterminated end of the transmission members is almost an open, in that nearly all the energy arriving is reflected and the phase shift of the reflected E-field is small. A large portion of the radiation striking antenna 12 from transmission members 20 and 22 is also returned thereto. The phase shift of this antenna-returned radiation should be somewhat near 0°. All these multiple end-reflections will interfere along the transmission member. Depending on the length of the member, this interference can be constructive or destructive. Constructive interference causes regions of high electric field to be generated at half-wavelength intervals along the transmission member. If the transmission member is just the right length (or an integer number of half wavelength longer or shorter), these high field regions will be very intense. If the transmission member length is altered by a quarter wavelength, the interference is destructive, and large, localized fields do not develop. However, when a large food load is placed on the transmission portion 14, this does not have as much significance, since most of the energy will be lost on the first pass over transmission members 20 and 22. Moreover, a resonant length of transmission members 20 and 22 in an empty oven can lead to very large field strengths near the ends of the transmission members and at every half wavelength spacing. This exacerbates any tendency to arc, and if the line is mounted on a lossy dielectric substrate such as paperboard, intense, half-wavelength spaced charring of the substrate can occur in an empty oven. Transmission members of odd quarter wavelength connected to a folded-dipole are near resonance and members of even quarter wavelength are near anti-resonance. As a result, for safety purposes, for heating devices not constituting an endless loop, transmission portion 14 should include even quarter-wavelength transmission members.

Figure 5:
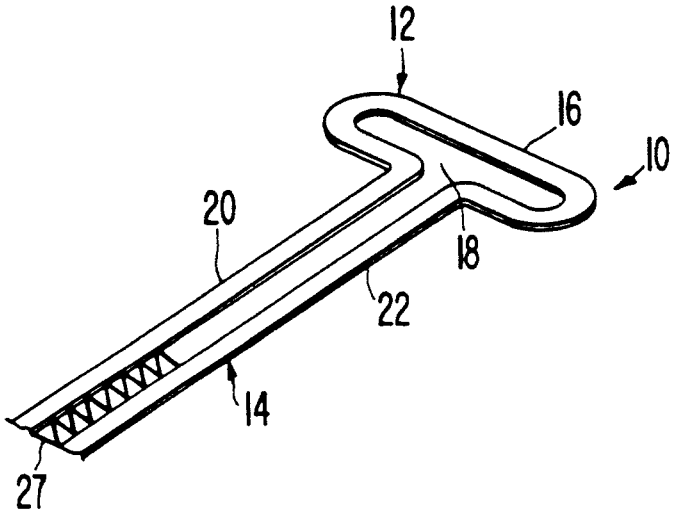
FIG. 5 illustrates a portion of a microwave heating device including a resistive element located between the members of the transmission portion thereof in parallel arrangement.
Figure 6:
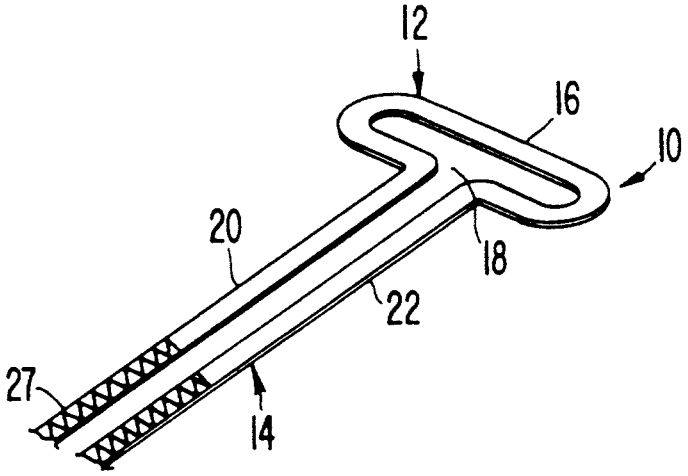
FIG. 6 illustrates a portion of a microwave heating device wherein the transmission members include resistive elements in series arrangement.

Device 10 may also include a resistive element 27 to directly convert the collected microwave energy into heat. The resistive element 27 may be integral with the end of the transmission portion (series) or bridge the transmission members 20 and 22 (parallel). FIG. 5 illustrates the resistive element 27 attached to transmission members 20 and 22 in parallel, while FIG. 6 illustrates resistive element 27 in series. Resistive element 27 may be made from any material which is capable of heating under the application of electrical current. Preferably, resistive element 27 is made from a conductive ink which can be applied across transmission members 20 and 22 for a parallel connection or the conductivity of the material composing transmission members 20 and 22 can be decreased at points where heating is desired for series relationship. In both cases, the energy will be attenuated as it propagates down the transmission members, and if the transition between the transmission members and the resistive element is gradual, little energy will be reflected from the resistive element. Experiments have shown that the use of resistive element 27 produces excessive heating is some circumstances, making its use inappropriate for some food items.

Figure 7:
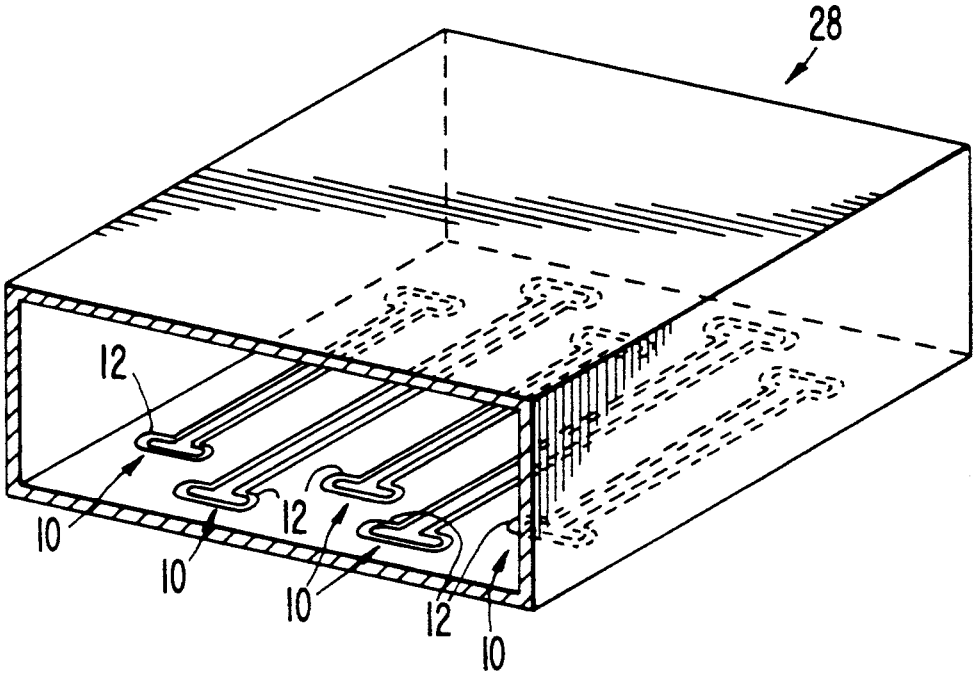
FIG. 7 illustrates a food package which includes a plurality of dual-folded-dipole microwave heating devices located on the bottom of the food package.

FIG. 7 illustrates the preferred environment of heating device 10 in a food carton 28. Specifically, as shown in the Figure, a plurality of heating devices 10 are arranged on the bottom of paperboard carton 28. Preferably, heating devices 10 have alternating lengths to avoid interference between the antennas 12 of each of the adjacent devices. The heating devices may be made from die cut aluminum foil board, as in FIG. 2, and laminated directly do the bottom of carton 28 or the heating devices may constitute separable members, such as illustrated in FIG. 3, so that each device is adhered to its own rigid substrate and then integrally attached to carton 28.

Figure 8:
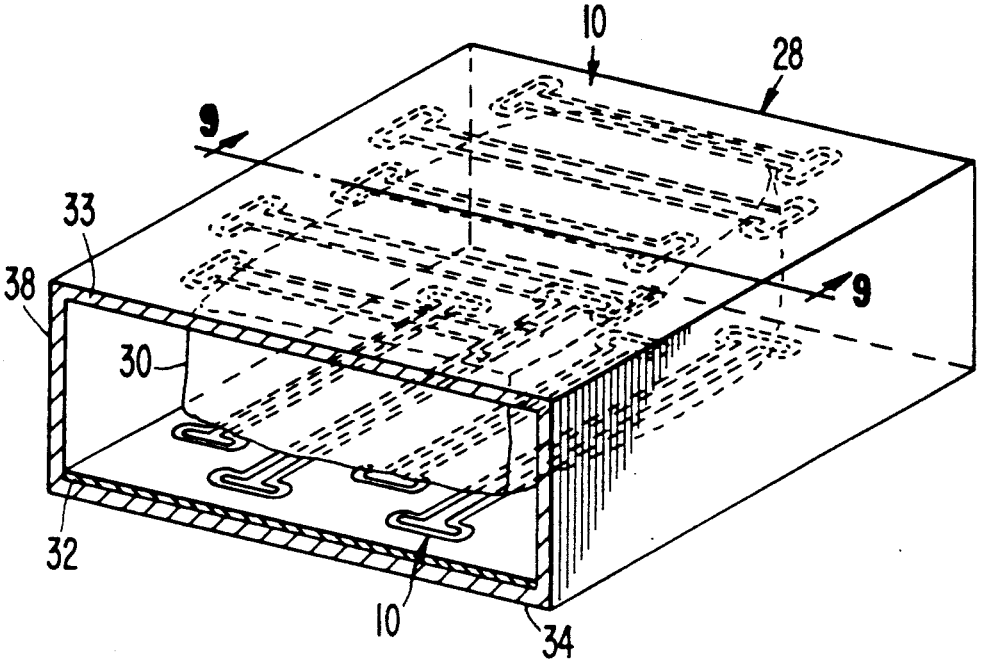
FIG. 8 illustrates a food package which includes a plurality of dual-folded-dipole microwave heating devices located on the top and the bottom of the package and further includes a food item held therein.

By providing heating devices 10 integral with a food carton, food stored within the carton can also be cooked therein. FIG. 8 illustrates such an arrangement wherein a plurality of heating devices 10 are arranged on both the top wall 33 and the bottom wall 34 of the carton 28. Such an arrangement will allow the enhanced heating of both sides of food item 30 contained within carton 28. Although not shown, heating devices 10 may also be arranged on the sides of carton 28 to provide enhanced heating of the side of food item 30 if so desired. By providing heating devices which include a separate antenna 12 for capturing microwave energy in the microwave oven cavity, problems associated with "shielding" by heating devices located on opposite sides of food item 30 in conventional, one-source ovens is virtually eliminated by heating device 10 of the present invention.

Figure 9:
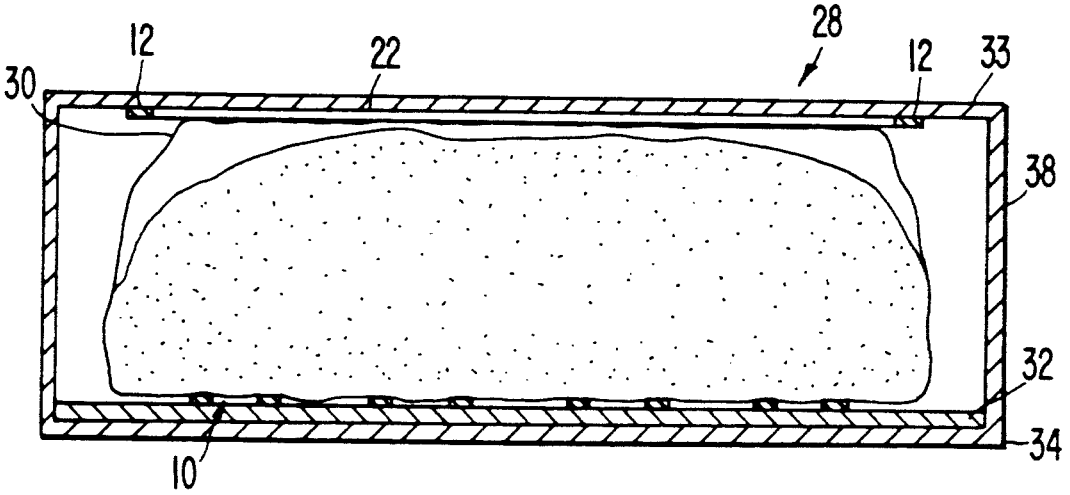
FIG. 9 illustrates the food package of FIG. 8 taken along line 9—9.

FIG. 9 provides a cross-sectional view of the carton 28 arrangement of FIG. 8 taken along lines 9—9. It is clear in this view that both the top and the bottom surfaces of food item 30 will experience enhanced grilling, crisping, or browning due to the position of heating devices 10. In addition, many food items, such as hamburgers, expel a large amount of juices during cooking. If too much liquid is permitted to pool up in the bottom of carton 28, there will no longer be sufficient contact between the lower surface of food item 30 and heating devices 10. Contact between the surface of the food item and heating device 10 is very important. Also, the food item will not dry sufficiently to permit the formation of grill marks. Therefore, in order to wick these juices away from the surface of the food item, an absorbent layer 32 may be provided below heating devices 10 and the bottom wall 34. Absorbent layer 32 may be made from any conventional absorbent paper, such as, but not limited to, 601b WF waterleaf produced by James River Corporation in Parchment, Mich.

Further, the food item may suspended upon the heating device to permit the juices to fall below the food surface, such as a raised tray including holes to remove excess liquid from the lower food surface. This arrangement will also prevent unwanted juices from escaping the carton within the oven cavity. Without such absorbency or liquid removal, the integrity of carton 28 could also be jeopardized by the excessive juices breaking down the paperboard food carton and preventing easy removal from the oven after cooking.

Figure 10:
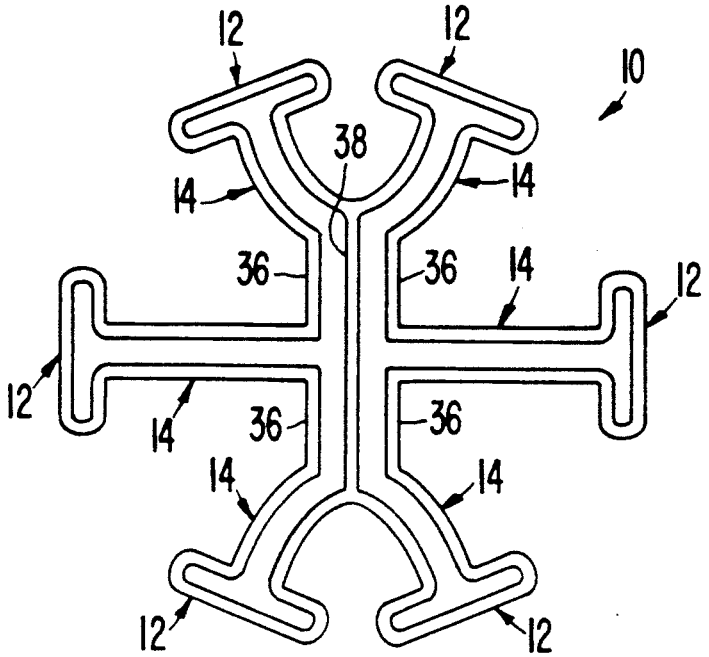
FIG. 10 illustrates one embodiment of a single heating device including a plurality of antennas and transmission portions.
Figure 11:
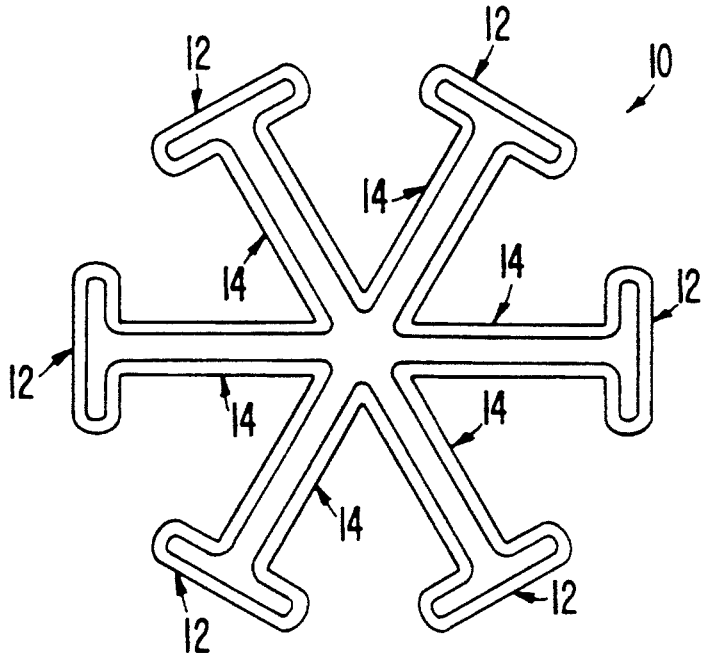
FIG. 11 illustrates a second embodiment a single dual-endless loop heating device including a plurality of folded-dipole antennas and transmission portions.
Figure 12:
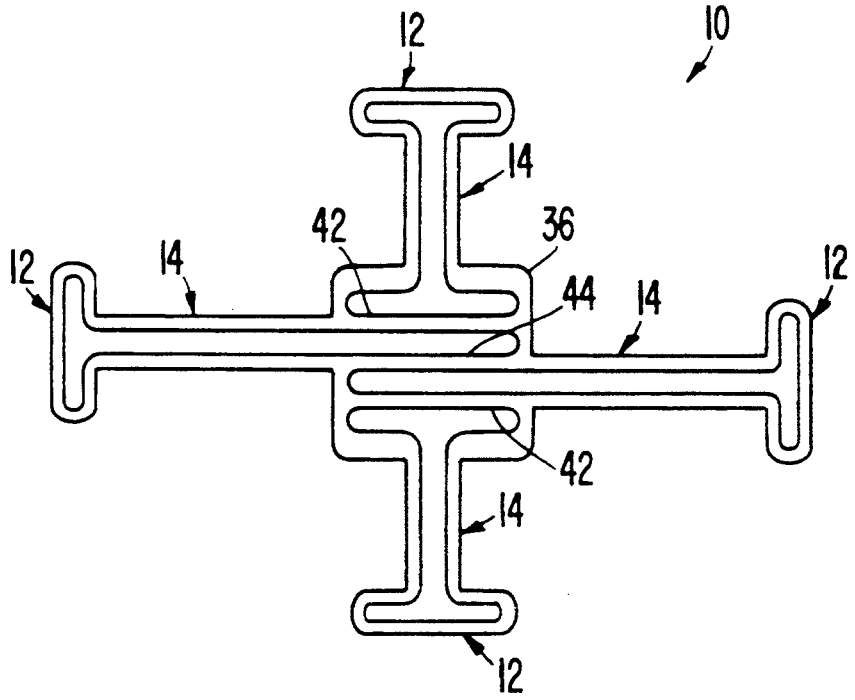
FIG. 12 illustrates third embodiment of a single heating device including a plurality of folded-dipole antennas and transmission portions.

FIGS. 10–12 show additional embodiments of the present invention for capturing heat from one portion of the microwave oven and transferring the energy to the surface of a food item to be grilled, crisped or browned. Specifically, FIG. 10 illustrates heating device 10 including a plurality of antennas 12 and transmission portions 14. Each of the transmission members of transmission portion 14 are joined to an adjacent transmission portion by at least a small joining section 36 or directly thereto, as in the upper and lower pair of antennas shown in FIG. 10. In addition, a central transmission member 38 is provided for connecting the upper and lower pair of antennas.

FIG. 11 illustrates a second embodiment of heating device 10 including a plurality of antennas 12 and transmission portions 14 wherein each of the transmission members of portions 14 are joined to a transmission member of an adjacent transmission portion 14. FIG. 12 illustrates a third embodiment of heating device 10 including four antennas 12 and corresponding transmission portions 14 wherein transmission portions 14 terminate in a grill structure 40 centrally located among the plurality of antennas. Portions of the transmission members of transmission portion 14 may actually enter the grill structure 40 to form a portion of the grill, as shown at grill sections 42, or exit through the opposite side thereof to form a corresponding transmission member for the opposing transmission portion, as shown at grill section 44. These unique embodiments further enhance the amount of microwave energy captured by the antennas and ultimately directed to a food item being crisped or grilled. Although defined configurations are presented in FIGS. 10–12, numerous additional configurations are also contemplated and should fall within the scope of the present invention.

Figure 13:
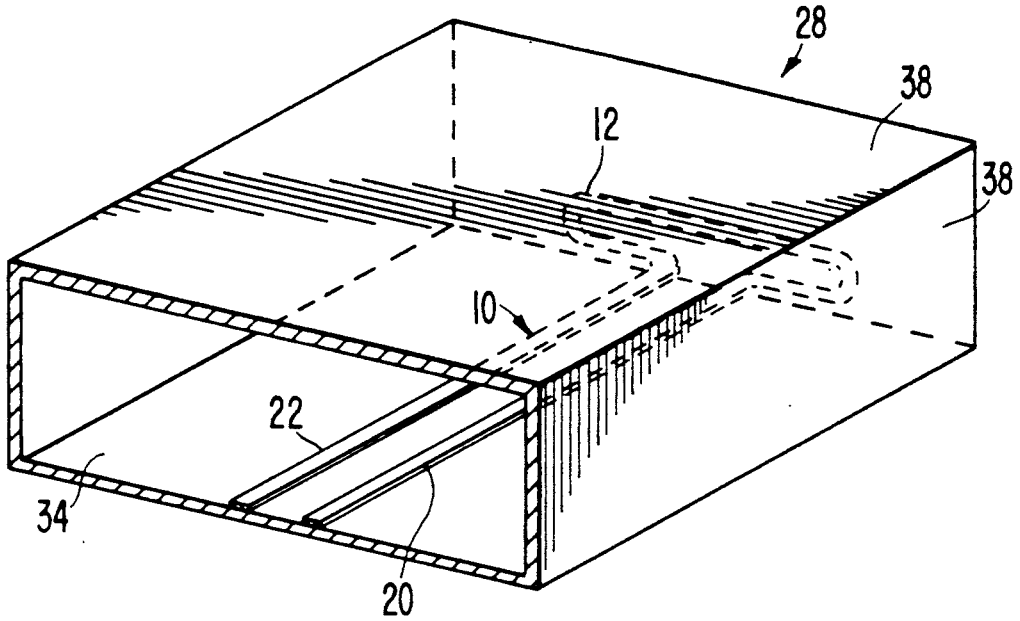
FIG. 13 illustrates a second embodiment of a food package including a single folded-dipole of the present invention.

As clearly shown in FIGS. 7–1, the food item is placed on transmission members 20, 22 such that antenna 12 is located outside of the food item to enable the antenna to capture microwave energy and ultimately direct it to the food item. In some cases, the food item may be so large that it covers a majority of the bottom wall 34. As a result, carton 28 may be designed, as illustrated in FIG. 13, such that antenna 12 extends out of the plane in which the transmission members lie, for example, onto side walls 38 to allow the folded-dipole antenna to properly capture the microwave energy. A heating device 10 having both a single antenna 12 and double antennas 12 can be used.

Figure 14:
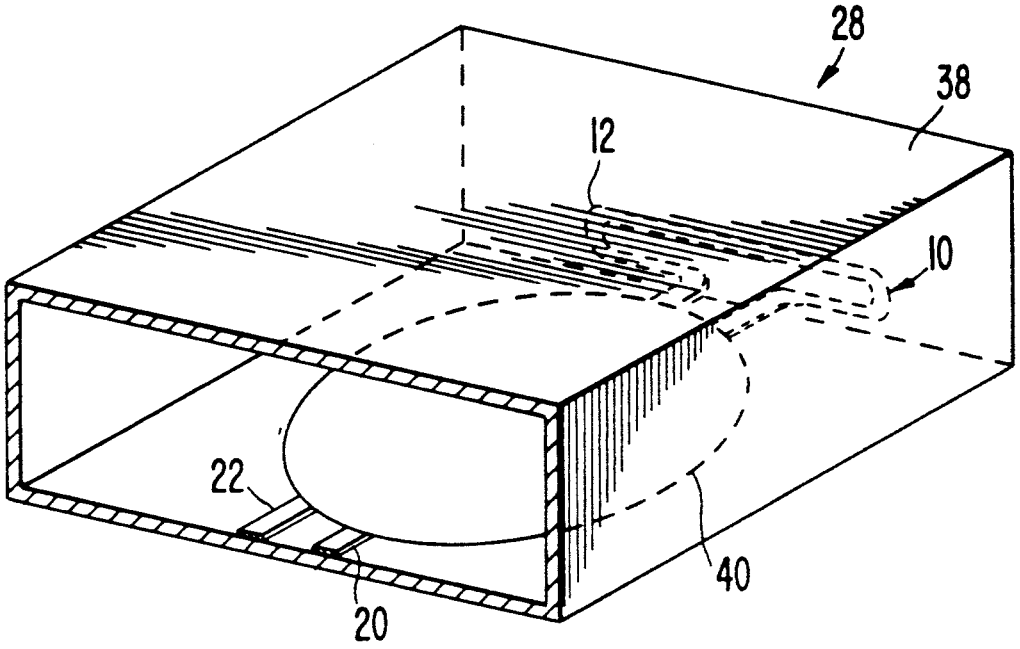
FIG. 14 illustrates a food package similar to the package shown in FIG. 13 further including a microwave interactive portion.
Figure 15:
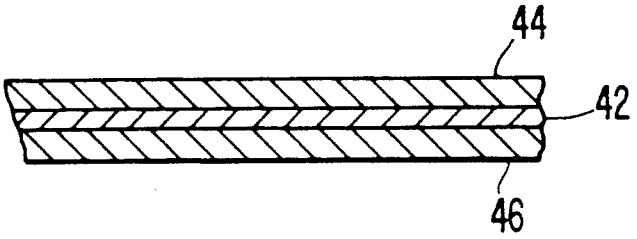
FIG. 15 is a diagrammatic representation of a microwave interactive heating element.

In addition, carton 28 may include another heating element in combination with heating device 10. Specifically, FIG. 14 illustrates a first heating element 40 located adjacent transmission members 20, 22 and positioned on bottom watt 34 of carton 28. First heating element 40 is, preferably, a laminate which includes a microwave interactive layer 42 formed on a film 44. The microwave interactive material is preferably positioned between film 44 and a rigid substrate 46, such as paperboard. FIG. 15 illustrates the preferred laminate. The microwave interactive layer 42 is a thin layer of material which generates heat in response to microwave energy, unless treated to reduce or eliminate this capability. As used herein, microwave responsive is defined to relate to both heating device 10 and heating element 40, while microwave interactive is defined to relate to heating element 40 comprising a layer of microwave interactive material capable of generating heat in response to microwave energy, described in greater detail below.

Specifically, the microwave interactive layer 42 may be applied to or deposited on film 44 in a number of methods known in the art, including vacuum vapor deposition, sputtering, printing and the like. Vacuum vapor deposition techniques are preferred. The microwave interactive layer 42 may be any suitable lossy material that will generate heat in response to microwave energy. Preferred microwave interactive materials useful in forming layer 42 include compositions containing metals or other materials, such as aluminum, iron, nickel, copper, silver, stainless steel, chrome, magnetite, zinc, tin, iron, tungsten and titanium. Some carbon-containing composition are also suitable for this purpose. These materials can be used alone or in combination, and the composition selected may be used in powder, flakes, or fine particles.

The film layer 44 functions both as a base on which the microwave interactive layer 42 is deposited and as a barrier to separate the food item from the microwave interactive layer 42. The film layer 44 must be sufficiently stable at high temperatures suitable for cooking the food item. Film layer 44 may be formed from a variety of stable plastic films, including those made from polyesters, polyolefins, nylon, cellophane and polysulfones, By placing first microwave heating element 40 adjacent heating device 10 on transmission members 20, 22, the heating effect of element 40 is given a boost to thereby provide increased or enhanced generation of heat in response to microwave energy. As a result, food items, which require more heat than that which is provided by a conventional heating element 40 and also requires a larger area of surface heating than can be provided by heating device 10, can be adequately heated and cooked in a microwave oven using carton 28 designed in accordance with the embodiment of FIG. 14.

Figure 16:
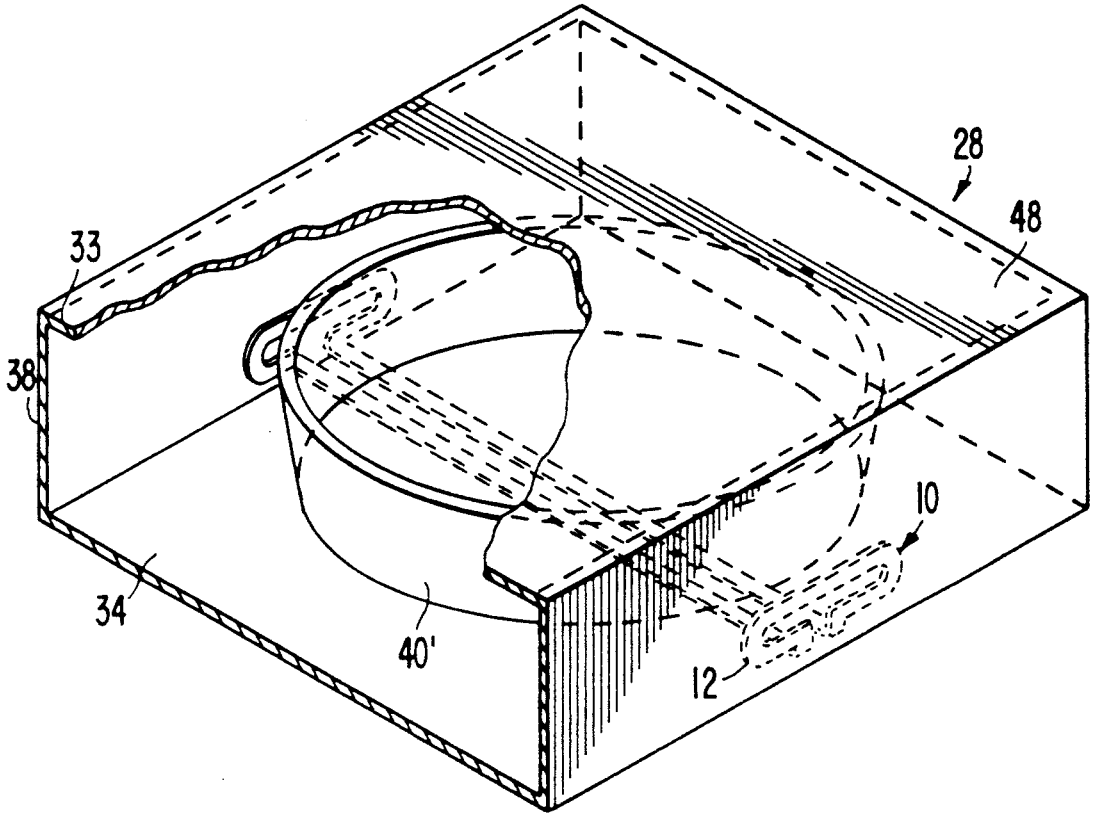
FIG. 16 illustrates another embodiment of a food package including a single folded-dipole antenna of the present invention further including an inner microwave interactive portion which cradles a food item.
Figure 17:
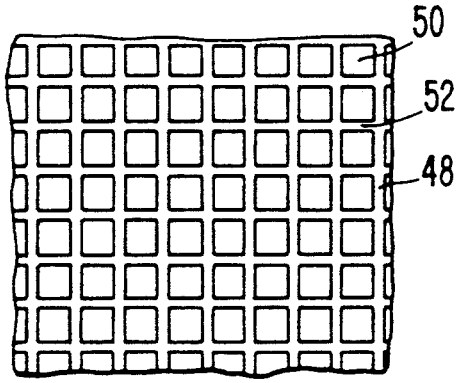
FIG. 17 illustrates a microwave interactive layer deactivated in a grid pattern.

Many food items, such as pot pies or fruit pies, not only require surface heating or browning of the bottom surface, but also the side and top surfaces. Yet another embodiment of carton 28 is illustrated in FIG. 16. Specifically, FIG. 16 shows carton 28 including first heating element 40' on bottom wall 34. In this embodiment, heating device 10 includes two antennas positioned on opposing side walls 38. However, depending upon the degree of microwave energy increase to heating element 40', a single antenna could also possibly be used.

In addition, first heating element 40' is three-dimensionally shaped into a container to cradle a food item, such as a pot pie, so that the bottom and side surfaces of the food item are in heat transfer relationship with film 44. Such a container can be formed by any conventional process, such as, for example deep drawing. By placing heating element 40' on transmission members 20, 22, the amount of heat provided to the surface of the food item can be increased. Specifically, an undesirable soggy spot on the bottom of a pot pie can be eliminated using the carton illustrated in FIG. 16.

Carton 28 may also include a second heating element 48 located on top wall 33. Heating element 48 is similar to first heating element 40. In addition, heating element 48 may also be selectively deactivated in a predetermined pattern, such that some areas are treated to reduce or eliminate the microwave material's ability to generate heat. Reduction or elimination of the heat generating capability of the microwave interactive material in heating element 48 may be accomplished by a wide variety of methods, such as, for example, demetallization described in U.S. Pat No. 4,398,994; chemical deactivation described in U.S. Pat. No. 4,865,921 to Hollenberg et al.; or an abrasion process described in U.S. Pat. No. 4,908,246 to Fredricks et al., the latter two patents being assigned to the assignee of the present application. These methods are but a few of the possible methods of deactivating the microwave interactive material of heating element 48.

By deactivating certain areas of the microwave interactive material in a predetermined pattern, the heating capacity of various portions thereof can be selectively reduced or eliminated to modify its heating characteristics. A variety of patterns are also available, as described in U.S. Pat. No. 4,883,936 to Maynard et al., such as a grid pattern shown in FIG. 17, wherein first areas 50 of reduced interactivity are surrounded by a grid of second areas 52 having unaltered capability. Utilizing this second heating element 48 permits the heating and browning of the top surface of a food item held within first heating element 40' without detracting from the enhanced heating provided by first heating element 40'.

IDUSTRIAL APPLICABILITY

A microwave responsive heating device formed in accordance with the present invention has particular utility in microwave food packaging. In particular, the microwave responsive heating device of the present invention provides an economically feasible device for enhancing the heating of the surface of a food item which is designed to be an integral part of a disposable food package. A package designed to include heating devices of the present invention permits the microwave cooking of food items which have heretofore been unacceptable for microwave cooking by capturing microwave energy in one portion of a microwave oven and transferring it to the food surface in a different portion of the oven to crisp or grill the surface thereof.

It is understood, however, that various additional changes and modifications in the form and detail of the present invention illustrated in detail above may be made without departing from the scope and spirit of the present invention, as well as the invention's use in a variety of applications. It is, therefore, the intention of the inventors to be limited only by the following claims.

We claim:

1. A microwave responsive heating device useful in microwave food packaging for capturing microwave energy in a microwave oven and transmitting the energy to a surface of a food item, comprising antenna means spaced away from the food item for correcting the microwave energy and transmission means for transferring the collected energy to a food item surface heating zone, located separate from said antenna means, for heating the surface of the food item located in close proximity to said surface heating zone, said antenna means comprising a loop antenna wherein said antenna means and said transmission means are formed from electrically conductive materials and impedance matched.

2. A microwave responsive heating device of claim 1, wherein said antenna means and said transmission means are arranged in a folded-dipole configuration.

3. A microwave responsive heating device of claim 2, wherein said antenna means comprises an elongated loop of said conductive material having a narrow gap of a predetermined distance in the middle of an elongated side thereof.

4. A microwave responsive heating device of claim 3, wherein said elongated loop includes a folded section and a pair of collinear leg portions which are spaced apart by said narrow gap and electrically connected to said folded section to form said elongated loop.

5. A microwave responsive heating device of claim 4, wherein said transmission means comprises a pair of parallel members spaced apart by a distance sufficient to cause impedance matching of said antenna means and said transmission means.

6. A microwave responsive heating device of claim 5, wherein said conductive material is a metal wire.

7. A microwave responsive heating device of claim 6, wherein said wire is cylindrical and said legs and said folded section of said antenna means have a uniform diameter and wherein the ratio of the distance between the centers of said pair of parallel members and the diameter of said wire is approximately 5.7.

8. A microwave responsive heating device of claim 5, wherein said conductive material is metal foil.

9. A microwave responsive heating device of claim 8, wherein said metal foil comprises aluminum.

10. A microwave responsive heating device of claim 9, wherein said legs and folded portion of said antenna means are of uniform width and wherein the ratio of the distance between the centers of said pair of parallel members and the width of said parallel members is approximately 2.85.

11. A microwave responsive heating device of claim 5, wherein said conductive material is conductive ink printed on a dielectric substrate.

12. A microwave responsive heating device of claim 11, wherein said conductive ink comprises silver.

13. A microwave responsive heating device of claim 5, further including a resistive means located opposite said antenna means along said transmission means for converting microwave energy captured by said antenna means into thermal energy.

14. A microwave responsive heating device of claim 13, wherein said resistive means is connected between said transmission means in parallel.

15. A microwave responsive heating device of claim 13, wherein said resistive means is connected in series with said transmission means.

16. microwave responsive heating device of claim 5, including a plurality of antenna means and a plurality of transmission means wherein said pairs of parallel members of said transmission means are integrally joined to adjacent ones of said members of said plurality of transmission means to form at least one endless loop.

17. A microwave responsive heating device of claim 4, wherein said antenna is approximately 0.48 of a microwave wavelength in length.

18. A microwave responsive heating device of claim 4, wherein said device includes a pair of antenna means located at opposite ends of said transmission means.

19. A microwave responsive heating device associated with a carton for storing and cooking a food item in a microwave oven wherein the device captures microwave energy in the microwave oven and transmits the energy to a surface of a food item held within said carton, comprising antenna means spaced away from the food item for collecting the microwave energy and transmission means for transferring the collected energy to a food item surface heating zone, located separate from said antenna means, for heating the surface of the food item located in close proximity to said surface heating zone wherein said surface heating zone is integral with a portion of the carton, said antenna means comprising a loop antenna wherein said antenna means and said transmission means are formed from electrically conductive materials and impedance matched.

20. A microwave responsive heating device of claim 19, wherein said antenna means and said transmission means are arranged to form a folded-dipole.

21. A microwave responsive heating device of claim 20, wherein said antenna means comprises an elongated loop of said conductive material having a narrow gap of a predetermined distance in the middle of an elongated side thereof.

22. A microwave responsive heating, device of claim 21, wherein said elongated loop includes a folded section and a pair of collinear leg portions which are spaced apart by said narrow gap and electrically connected to said folded section to form said elongated loop.

23. A microwave responsive heating device of claim 22, wherein said transmission means comprises a pair of parallel members spaced apart by a distance sufficient to cause impedance matching of said antenna means and said transmission means.

24. A microwave responsive heating device of claim 23, wherein said conductive material is a metal wire.

25. A microwave responsive heating device of claim 24, wherein said wire is cylindrical and said legs and said folded section of said antenna means have a uniform diameter and wherein the ratio of the distance between the centers of said pair of parallel members and the diameter of said wire is approximately 5.7.

26. A microwave responsive heating device of claim 23, wherein said conductive material is metal foil.

27. A microwave responsive heating device of claim 26, wherein said metal foil comprises aluminum.

28. A microwave responsive heating device of claim 27, wherein said legs and folded portion of said antenna means are of uniform width and wherein the ratio of the distance between the centers of said pair of parallel members and the width of said parallel members is approximately 2.85.

29. A microwave responsive heating device of claim 23, wherein said conductive material is conductive ink printed on a dielectric substrate.

30. A microwave responsive heating device of claim 29, wherein said conductive ink comprises silver.

31. A microwave responsive heating device of claim 22, wherein said antenna is approximately 5.875 cm.

32. A microwave responsive heating device of claim 22, wherein said device includes a pair of antenna means located at opposite ends of said transmission means.

33. A microwave responsive heating device of claim 32 wherein the carton includes at least a bottom portion, a top portion and side portions and said surface heating zone is integral with at least one of said bottom portion, said top portion and said side portions.

34. A microwave responsive heating device of claim 33, wherein the carton is shaped to accommodate the food item and said surface heating zone is integral with said bottom portion and said top portion to provide surface heating of opposing sides of the food item.

35. A microwave responsive heating device of claim 34, wherein the carton further includes an absorbing means for absorbing liquid produced while cooking the food item in the microwave oven, said absorbent sheet positioned opposite said food item from said surface heating zone.

36. A microwave responsive heating device of claim 35, wherein said absorbing means comprises absorbent paper.

37. A microwave responsive heating device of claim 33, wherein said transmission means are positioned on the bottom portion of said carton and said antenna means are positioned on opposing side portions of said carton.

38. A microwave responsive heating device of claim 37, further including a first microwave interactive means capable of converting microwave energy to heat energy for heating the surface of a food item proximate thereto wherein said first microwave interactive means is positioned adjacent said transmission means on the bottom portion of said carton which thereby produces enhanced microwave interactivity.

39. A microwave responsive heating device of claim 38, wherein said first microwave interactive means comprises a first heating element formed from a layer of microwave interactive material supported on a substrate.

40. A microwave responsive heating device of claim 39, wherein said heating element is three-dimensionally shaped to cradle the food item and to maintain the food item in heat transfer relationship with said microwave interactive material for surface browning or crisping of said food item.

41. A microwave responsive heating device of claim 40, further including a second microwave interactive means capable of converting microwave energy to heat energy wherein said second microwave interactive means is located on the top portion of the carton to heat the upper surface of the food item.

42. A microwave responsive heating device of claim 41, wherein said second microwave interactive means comprises a second heating element formed from a layer of microwave interactive material supported on a substrate.

43. A microwave responsive heating device of claim 42, wherein said second heating element includes at least a first area having a reduced capability to generate heat in response to microwave energy and at least a second area having an unaltered capability to generate heat in response to microwave energy wherein said second area is arranged in a predetermined pattern relative to said first area.

44. A microwave responsive heating device of claim 43, wherein said second area forms a grid pattern around said first area.

45. A microwave responsive heating device associated with a carton for storing and cooking a food item in a microwave oven wherein the device captures microwave energy in the microwave oven and transmits the energy to a surface of a food item held within said carton, comprising antenna means spaced away from the food item for collecting the microwave energy, said antenna means comprising a loop antenna, transmission means for transferring the collected energy to a food item surface heating zone, located separate from said antenna means, for heating the surface of the food item located in close proximity to said surface heating zone wherein said surface heating zone is integral with a portion of the carton, and a microwave interactive means capable of converting microwave energy to heat energy for heating the surface of a food item proximate thereto wherein said microwave interactive means is positioned adjacent said transmission means to thereby produce enhanced microwave interactivity.

46. A microwave responsive heating device of claim 45, wherein said antenna means and said transmission means are formed from electrically conductive materials and are impedance matched.

47. A microwave responsive heating device of claim 46, said carton including at least a bottom portion, a top portion and side portions and said surface heating zone is integral with at least one of said bottom portion, said top portion and said side portions wherein said microwave interactive means is positioned adjacent said transmission means on the bottom portion of said carton and said antenna means are positioned on opposing side portions of said carton.

* * * * *